US005206663A

United States Patent [19]

Yamamoto et al.

[11] Patent Number: 5,206,663

[45] Date of Patent: Apr. 27, 1993

[54] THERMAL HEAD

[75] Inventors: Takayuki Yamamoto; Shigenori Ota, both of Aira, Japan

[73] Assignee: Kyocera Corporation, Kyoto, Japan

[21] Appl. No.: 784,556

[22] Filed: Oct. 29, 1991

[30] Foreign Application Priority Data

Oct. 31, 1990 [JP] Japan ..... 2-114903[U]

[51] Int. Cl.[5] ..... B41J 2/325

[52] U.S. Cl. ..... 346/76 PH

[58] Field of Search ..... 346/76 PH

[56] References Cited

U.S. PATENT DOCUMENTS 4,963,886 10/1990 Fukuda et al. ..... 346/76 PH

FOREIGN PATENT DOCUMENTS 0048375 3/1985 Japan .
61-268464 11/1986 Japan .
62-41549 3/1987 Japan .
62-94846 6/1987 Japan .
63-1341 1/1988 Japan .
0078860 3/1989 Japan .
1-112942 7/1989 Japan .
1-165246 11/1989 Japan .
2-86463 3/1990 Japan .

*Primary Examiner*—Benjamin R. Fuller
*Assistant Examiner*—Huan Tran
*Attorney, Agent, or Firm*—Spensley Horn Jubas & Lubitz

[57] ABSTRACT

The drive circuit elements mounted on a heat resistant substrate for composing a thermal head were covered with a protective layer made of epoxy resin in the prior art. This epoxy resin is greatly different from the heat resistant substrate in the coefficient of linear expansion and is relatively high in Young's modulus, and therefore due to rise or fall of temperature in the manufacturing process, the shrinkage of the protective layer is greater than the shrinkage of the heat resistant substrate, and hence the heat resistant substrate is warped. Such warp may be eliminated by selecting a resin having a coefficient of linear expansion almost same as the coefficient of linear expansion of the heat resistant substrate as the material for the protective layer.

19 Claims, 4 Drawing Sheets

THERMAL HEAD

BACKGROUND OF THE INVENTION

1. Field of the Invention

The present invention relates to a thermal head, and more particularly to improvements of the material for the protective layer for covering the plural drive circuit elements used for heating and driving a heating resistance element row of a thermal head.

2. Description of the Prior Art

FIG. 2 is a sectional view of a typical thermal head 1, which is referred to in the explanation of the prior art below, as well as the embodiment described below. The thermal head 1 comprises a heat resistant substrate 2 possessing an electric insulating property made of ceramics such as aluminum oxide $Al_2O_3$. On the heat resistant substrate 2, a heat reserve layer 3 made of glass or similar material is formed, as being extending in a band form in the direction vertical to the sheet of paper in FIG. 2. At one side in the direction crossing the longitudinal direction of the heat reserve layer 3, for example, silver paste is printed to form a thick film common electrode layer 4.

Covering the entire surface of the heat resistant substrate 2, a resistance element layer 5 made of tantalum nitride $Ta_2N$ or the like is formed. On the resistance element layer 5, in the upper part of the thick film common electrode layer 4, a thin film common electrode 6 extending parallel to the thick film common electrode layer 4 is formed of aluminum or other metal material, by thin film technology such as sputtering and etching. Relating to the heat reserve layer 3, on the opposite side of the thin film common electrode 6, plural band-shaped individual electrodes 7 are formed in plural rows in the direction vertical to the sheet of paper in FIG. 2, and the resistance element layer 5 enclosed by these thin film common electrode 6 and individual electrodes 7 is composed as a heating resistance element row 8 made of plural heating resistance elements.

On the individual electrode 7, plural drive circuit elements 9 for heating and driving selectively the heating resistance element row 8 are disposed parallel to the array direction of the heating resistance element row 8. To the drive circuit elements 9, thermal printing data and various control signals are supplied through signal lines 10 formed simultaneously when forming the individual electrode 7 on the heat resistance substrate 2. The drive circuit elements 9 possess bumps 11 for realizing connection with the individual electrode 7 and signal lines 10, which are connected by face-down bonding.

To the signal lines 10, an external wiring substrate 12 is connected. The external wiring substrate 12 comprises a support film 13 made of synthetic resin material, and a circuit wiring 14 formed on the support film 13. On the other hand, the heat resistance substrate 2 is adhered onto a cooling plate 15, with adhesive, which is formed by press forming or die-cast forming of, for example, aluminum. On the cooling plate 15, the external wiring substrate 12 is fixed through a spacer 16 made of synthetic resin material. Covering the thin film common electrodes 6 and individual electrodes 7, a wear-resistant layer 17 is formed by thin film technology such as sputtering, and the plural drive circuit elements 9 are entirely covered in the array direction with a protective layer 18 made of epoxy resin or the like.

This conventional thermal head involved the following problems.

(1) The protective layer 18 is made of epoxy resin. The epoxy resin has a coefficient of linear expansion of $2.0\times10^{-5}$° C.$^{-1}$, and the ratio b/a of the coefficient of linear expansion b of the epoxy resin to the coefficient of linear expansion a of the substrate 2 is 2.74, which is significantly different from $0.73\times10^{-5}$° C.$^{-1}$ of the ceramics used to compose the heat resistant substrate 2. The epoxy resin has a relatively high modulus of elasticity of 1300 kg/mm$^2$.

On the other hand, to form the protective layer 18, an epoxy resin is applied to coat the entire surface of the plural drive circuit elements 9, and is hardened by heating at, for example, 120° to 150° C. Afterwards, when cooling to ordinary temperature of, for example, 25° C., due to the difference in the coefficient of linear expansion, the protective film 18 shrinks more than the heat resistant substrate 2, and what is more the modulus of elasticity of the protective layer 18 of the epoxy resin is relatively large, so that the heat resistant substrate 2 may be warped in the direction vertical to the sheet of paper in FIG. 1.

In such warped state, when adhering the heat resistant substrate 2 and cooling plate 15, the layer thickness of the adhesive layer becomes nonuniform along the array direction of the heating resistance element row 8, and heat dissipation from the heating resistance element row to the cooling plate 15 becomes nonuniform. Such nonuniformity causes uneven contrast and lowers printing quality in thermal recording. As a result, the working efficiency drops in relation to positioning in this adhesion step. Besides, in connection of the signal lines 10 and external wiring substrate 12, positioning precision is lowered, and the job efficiency drops.

To prevent such inconveniences, if attempted to straighten the warp of the heat resistant substrate 2 by external force after hardening of the protective layer 18, the peripheral edge of the protective layer 18 may be easily cracked because of the large modulus of elasticity of the protective layer 18. In the event of such crack, for example, water may invade into the protective layer 18 to corrode the individual electrodes 7, or due to progress of corrosion, the individual electrodes 7 may be disconnected.

To avoid such problems, it is conventionally known to use a silicon resin for the protective layer 18. Such silicon resin is a so-called silicone rubber, and although its coefficient of linear expansion is also very different from that of the heat resistant substrate 2, it is relatively small in the modulus of elasticity. Accordingly, if a difference is caused in the contraction against the heat resistant substrate 2 due to temperature drop after forming the protective layer 18, the protective layer 18 is deformed elastically so that the heat resistance substrate 2 will not warp.

When using such silicon resin, however, since the elasticity is low, the hardness is low, and it is easily deformed when an external force is applied in the manufacturing process or during use, and the drive circuit elements 9 may be broken. Accordingly as in the conventional thermal head 1*a* in FIG. 1, a head cover 25 to cover the entire vicinity of the protective layer 18 is needed, and the number of parts increases, and the manufacturing process is complicated. The head cover 25 incorporates an elastic pressing member 27 inside of a groove 26 at a position opposite to signal lines 10, and the head cover 25 is fastened to the cooling plate 15 with a screw 28 through external wiring substrate 12 and spacer 16, and the external wiring substrate 12 is pressed and fixed to the signal lines 10.

Such protective layer 18 may contact with, in actual use, thermal paper 19 or transfer film, and in the case of silicon resin, the coefficient of friction is large when contacting, and paper jamming is likely to occur.

As described herein, the protective layer 18 of the conventional thermal head 1 is made of epoxy resin or silicon resin, and these resins involve the problems as mentioned above.

SUMMARY OF THE INVENTION

It is hence a primary object of the invention to solve the above technical problems, and present a thermal head simplified in the manufacturing process, enhanced in the printing quality, and downsized in structure.

To achieve the above object, the invention presents a thermal head composed by disposing a plurality of drive circuit elements for driving heating resistance elements along the array direction of heating resistance elements, on a substrate on which a plurality of heating resistance elements are arranged linearly, and covering the drive circuit elements with a resin possessing a nearly same coefficient of linear expansion as the coefficient of linear expansion of the substrate.

In the thermal head of the invention, plural heating resistance elements are disposed linearly on a heat resistant substrate, and plural drive circuit elements for heating and driving the heating resistance elements are arranged parallel to the array direction of the heating resistance elements on the heat resistant substrate. The plural drive circuit elements are covered with a protective layer made of a resin material possessing a coefficient of linear expansion almost same as the coefficient of linear expansion of the heat resistant substrate. Therefore, when forming the protective layer, the temperature is relatively high, and when the temperature later declines, a large difference does not occur in the contraction due to temperature drop between the protective layer and heat resistant substrate, thereby preventing formation of warp on the heat resistant substrate. As a result, the printing quality is outstandingly enhanced.

Besides, in the manufacturing process of the thermal head, too, it is possible to maintain so as not to cause undesired warp on the heat resistant substrate, and it is easy to position other constituent elements which are connected as being positioned to the heat resistant substrate, while the working process is simplified.

In the invention, the protective layer is formed by dispersing a filler of a relatively small particle size in the polyether amide resin material. Therefore, if there if a gap between the drive circuit elements and heat resistant substrate, by filling up this gap, the reliability of the thermal head may be enhanced. The protective layer of such material is small in viscosity, and when applying on such drive circuit elements, the layer thickness may be very thin, which contributes to downsizing of the thermal head.

According to the invention, in this way, the plural drive circuit elements are covered with a protective layer made of a resin material possessing a coefficient of linear expansion similar to the coefficient of linear expansion of the heat resistant substrate. Therefore, when forming the protective layer, the temperature is relatively high, and when the temperature later declines, a large difference does not occur in the contraction due to temperature drop between the protective layer and heat resistant substrate, thereby preventing formation of warp on the heat resistant substrate. As a result, the printing quality is outstandingly enhanced.

Besides, in the manufacturing process of the thermal head, too, it is possible to maintain so as not to cause undesired warp on the heat resistant substrate, and it is easy to position other constituent elements which are connected as being positioned to the heat resistant substrate, while the working process is simplified.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
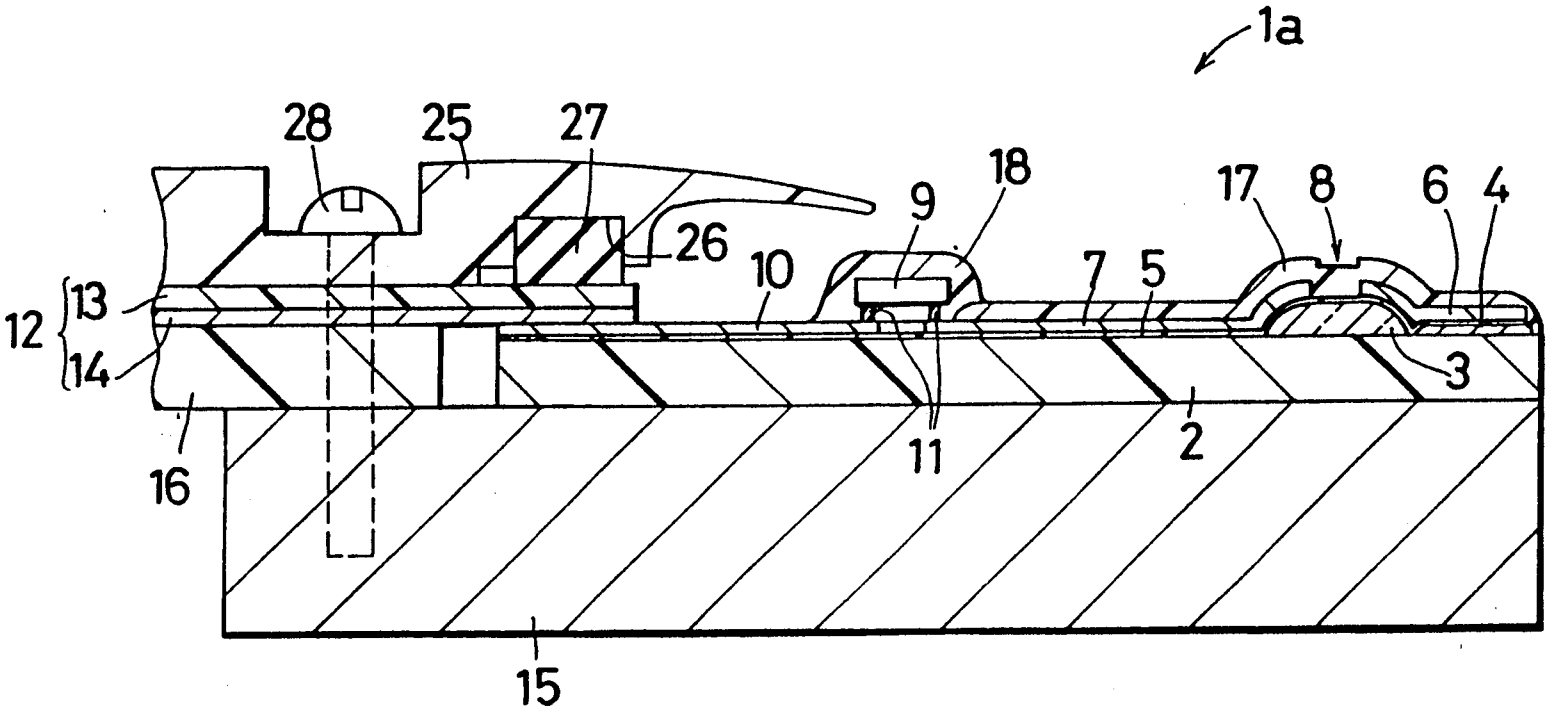
Fig. 1 Prior Art
FIG. 1 is a sectional view showing a conventional thermal head 1*a*.

Now referring to the drawing, preferred embodiments of the invention are described below.

Figure 2:
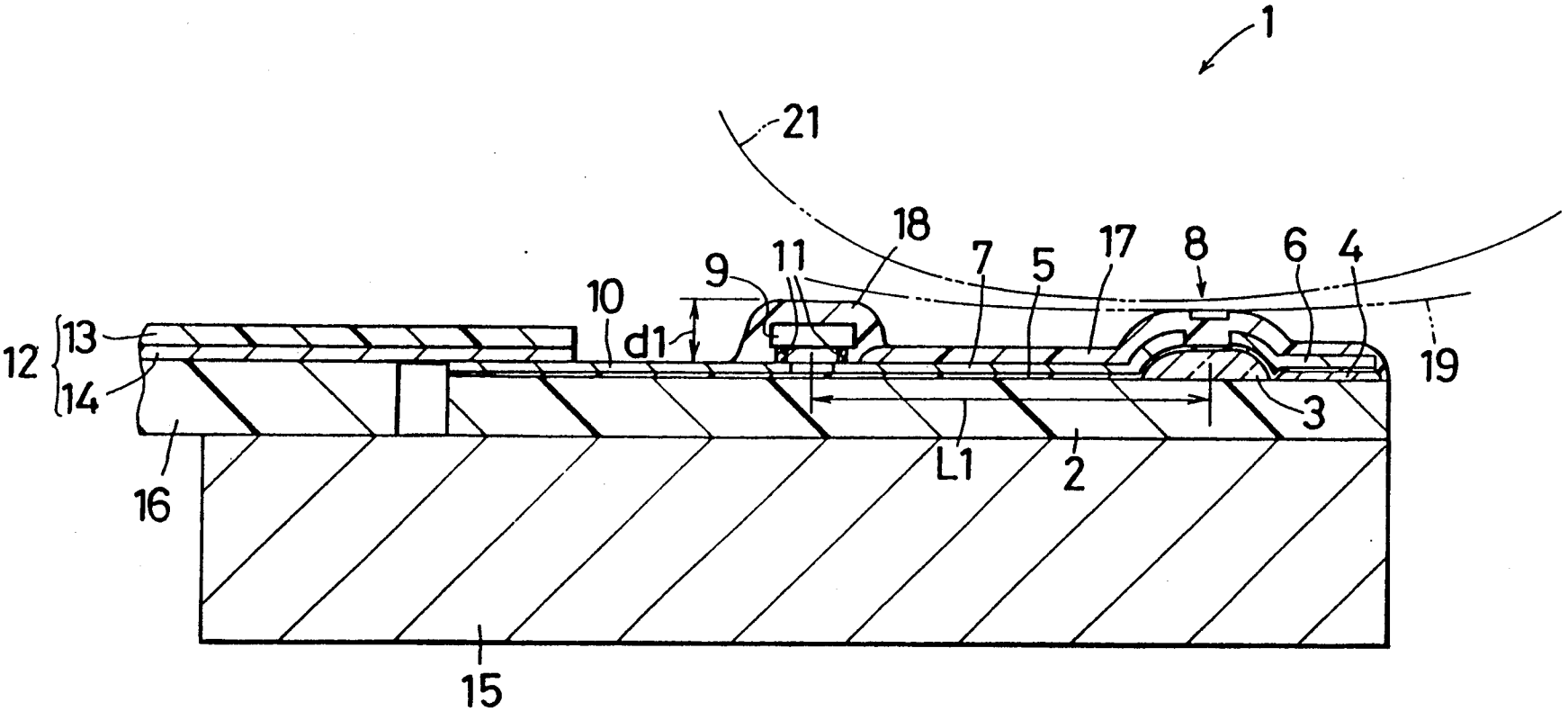
FIG. 2 is a sectional view of a thermal head 1 explaining an embodiment of the invention.
Figure 3:
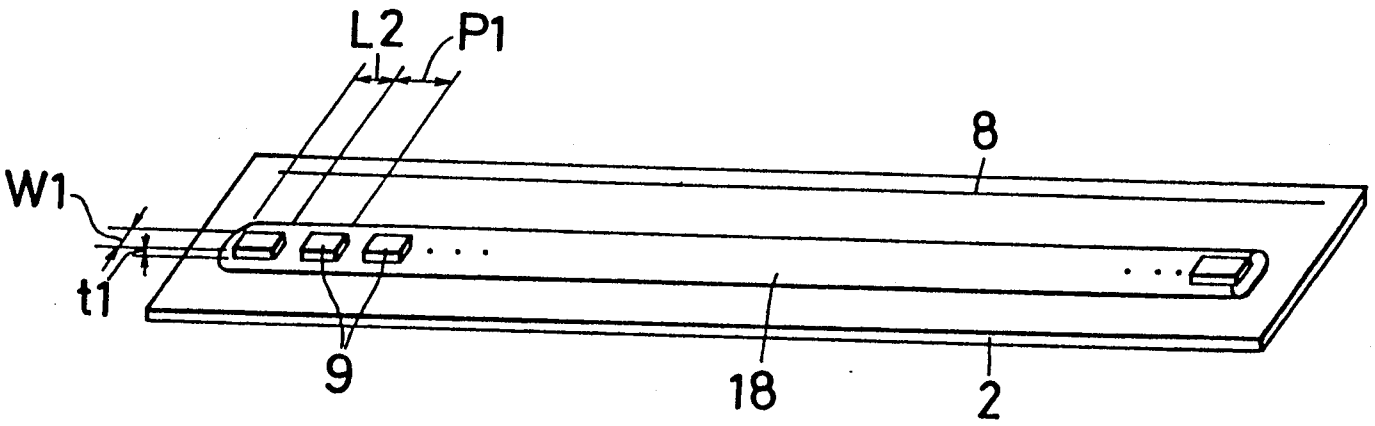
FIG. 3 is a perspective view of the thermal head 1.

FIG. 2 is a sectional view of a thermal head 1 in a typical structure, and FIG. 3 is a perspective view of the thermal head 1. The constitution in FIG. 2 was explained in relation to the prior art above, but it is further described below in relation to an embodiment of the invention. A heat resistant substrate 2 of a thermal head 1 is made of ceramics such as aluminum oxide $Al_2O_3$, and it possesses a coefficient of linear expansion of $0.73\times10^{-5}$° C.$^{-1}$ as mentioned above. On the heat resistant substrate 2, for example, a heat reserve layer 3 made of material such as glass is formed, as being extended like a band in the direction vertical to the sheet of paper in FIG. 2, near the end portion of the heat resistant substrate 2.

Adjacently to the heat reserve layer 3, a thick film common electrode layer 4 is formed by applying and baking, for example, silver paste by printing or other thick film technology. On almost entire surface of the heat resistant substrate 2 at this stage, a resistance element layer 5 made of tantalum nitride $Ta_2N$, nichrome Ni-Cr, ruthenium oxide $RuO_2$ or the like is formed by known vapor deposition, sputtering, etching or other thin film technology.

On the resistance element layer 5, commonly in part of the thick film common electrode layer 4 and heat reserve layer 3, a thin film common electrode 6 is formed by patterning and forming, for example, aluminum by the same thin film technology. Regarding the heat reserve layer 3, on the opposite side of the thin film common electrode 6, plural band-shaped individual electrodes 7 of the same material as the thin film common electrode 6 are formed in plural rows along the extending direction of the heat reserve layer 3. The resistance element layer 5 enclosed by the thin film common electrode 6 and the individual electrodes 7 is the individual heating resistance elements, which are arranged in plural rows along the extending direction of the heat reserve layer 3, thereby composing a heating resistance element row 8.

Drive circuit elements 9 for heating and driving the heating resistance element row 8 are disposed in a plurality along the array direction of the heating resistance element row 8 on the heat resistant substrate 2. The drive circuit elements 9 possess bumps 11 for connection, and they are connected to plural rows of signal lines 10 made of the same material as the individual electrodes and formed in the same manufacturing process, and the individual electrodes, by face-down bonding, and printing data and control signals for thermal recording are supplied from the signal lines 10.

Figure 4:
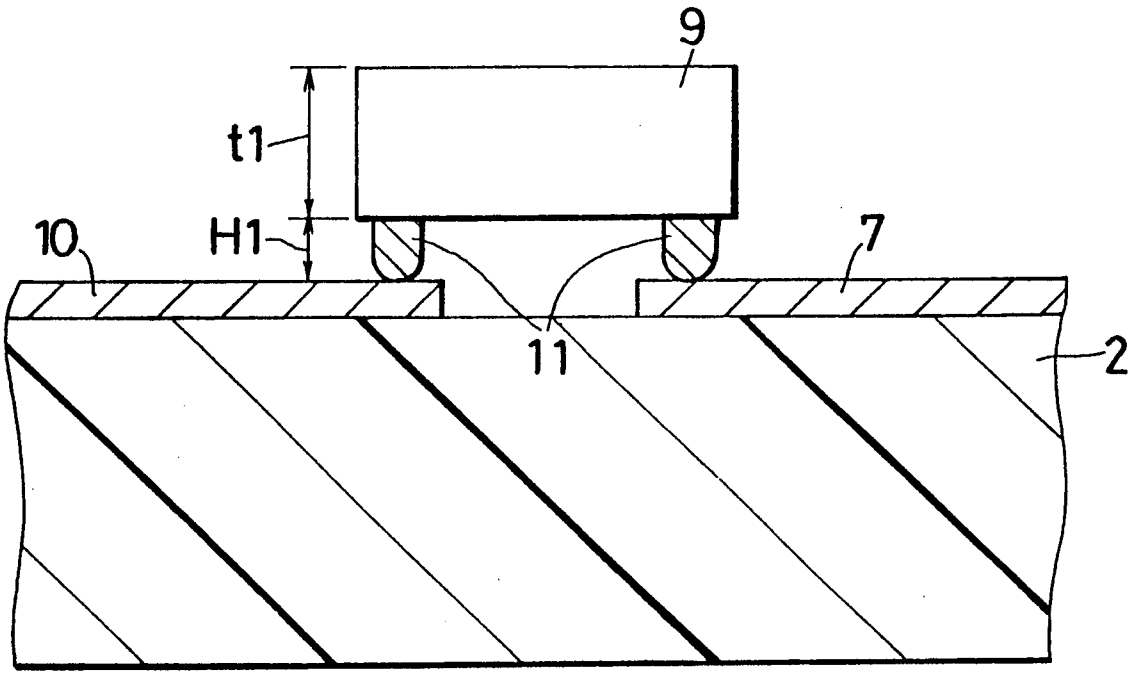
FIG. 4 is a magnified sectional view near drive circuit elements 9.

FIG. 4 is a magnified sectional view near the drive circuit elements 9. Referring also to FIG. 4, each one of the drive circuit elements 9 has an output of 64 bits, and a size of, when the array direction density of each heating resistance element is 8 dots/mm, width W1 in the direction orthogonal to the array direction of heating resistance element row 8 of, for example, 1.2 mm, length L2 in the array direction of, for example, 7 mm, and layer thickness t1 of, for example, 0.55 mm, being arranged in array pitch P1 of, for example, 8 mm. Besides, the bumps 11 are formed in a height of H1 (for example, 50 to 60 μm), and the individual electrodes 7 and signal lines are connected with solder or the like. By such method of connection, the heat generated by the use of the drive circuit elements 9 is released to the individual electrodes 7 and signal lines 10 through the bumps 11.

An external wiring substrate 12 for supplying print data and other signals to the signal lines 10 from outside is connected to the signal lines 10 with solder, anisotropic conductor or the like. The external wiring substrate 12 comprises an electrically insulating support film 13 made of synthetic resin material, and a circuit wiring 14 formed thereon.

Covering the thin film common electrode 6 and individual electrodes 7, a wear resistant layer 17 made of the same material is formed by thin film technology such as sputtering. Moreover, covering the portion responsible for connection of the drive circuit elements 9, and individual electrodes 7 and signal lines with drive circuit elements 9, a protective layer 18 made of a resin material possessing a coefficient linear expansion nearly same as that of the heat resistant substrate 2 and relatively low in elasticity is formed, in a height d1 of, for example, 0.8 mm or less from the heat resistant substrate 2.

The synthetic resin material for forming the protective layer 18 may be selected from many materials in a range satisfying the above characteristics, and in a preferred embodiment, it is a heat resistant resin, for example, a synthetic resin material mainly composed of polyether amide molecules, comprising ceramic material such as calcium carbonate $CaCO_3$, zinc oxide or fused silica (spherical filler), and a mixed material dispersing the filler having a nearly spherical shape is selected. As the protective layer, using polyether amide resin as the basic material, epoxy resin may be mixed and filler may be contained. The blending ratio of the resin material mainly composed of polyether amide molecules and the filler is selected in a range of 70 to 95 wt. % of filler, or preferably 80 to 90 wt. %. This is because the coefficient of linear expansion of the protective layer 18 decreases or increases by increasing or decreasing the blending ratio of the filler respectively, so that the coefficient of linear expansion of the protective layer 18 may be nearly equal to the coefficient of linear expansion of the heat resistant substrate 2.

When mixing a filler in the mixed resin material of epoxy resin and polyether amide resin made of the material for composing the protective layer 18, the blending ratio of the epoxy resin is desired to be 0.5 to 5 wt. %, which was known by experiment. More specifically, on the surface of the heat resistant substrate 2, there is a film made of a synthetic resin material for improving the moisture resistance and prevent corrosion (hereinafter it is called a solder resist). To improve the adhesion strength of such solder resist and the protective film 18, the epoxy resin is blended, but the adhesion strength is low if less than the above blending ratio range, and if exceeding the range, the coefficient of linear expansion of the protective layer 18 is extremely heightened. The particle size of the filler is selected in an average of 13 μm in a preferred embodiment, not exceeding the maximum size of 40 μm.

The reason of thus defining the filler particle size is found as follows by the experiment of the present inventor. The particle size of the filler as mentioned above is not uniform, but varied in a certain range. As this time, as shown in FIG. 2 and FIG. 4, the drive circuit elements 9 and the heat resistant substrate 2, or more specifically the resistant element layer 5 are spaced at the height H1 of the bumps 11. Therefore, when filler particles about the size of the height H1 enter between the drive circuit elements 9 and the resistance element layer 5, the active plane opposite to the resistance layer 5 of the driving circuit elements 9 may be damaged when expanding or contracting due to heat in the manufacturing process or usage of the thermal head 1. To avoid such accidents, in this embodiment, the maximum particle size of the filler is selected at 40 μm. Such filler, when mixed in the resin material, functions as follows:

(1) When a mixed resin material with the filler is applied to cover the drive circuit elements 9, it invades into the gap formed between the drive circuit elements 9 and heat resistant substrate 2 to fill it up. As a result, formation of air layer in this gap is prevented, corrosion of the individual electrodes 7 and signal lines 10 is arrested, so that the reliability may be enhanced.

(2) Lowering the coefficient of friction of the surface of the protective layer 18, if the end part of the thermal paper 19 contacts with the protective layer 18 when using the thermal head 1, it is allowed to slide smoothly to prevent paper jamming.

(3) As compared with a single resin material mainly composed of polyether amide molecules, the thermal conductivity increases, and release of heat generated in the drive circuit elements 9 during use of the thermal head 1 is encouraged.

The mixed resin material of this composition has been proven by the present inventor to have a coefficient of linear expansion of 0.5 to $1.0\times10^{-5}$° C.$^{-1}$, Young's modulus of 100 to 1000 kg/mm$^2$, or preferably 200 to 800 kg/mm$^2$, and pencil hardness of 3 to 5H. The Young's modulus of the mixed resin material is selected in the above range because of the following reason. That is, the higher the Young's modulus, the greater becomes the force to warp the heat resistant substrate 2 after thermal setting. Therefore, if after thermal setting of the protective layer 18, it can be selected in a range of substantially capable of suppressing the warp of the heat resistant substrate 2. By using the mixed resin material having such characteristics in the protective layer 18, the following effects are realized.

According to the experiments repeated by the present inventors, it is found that the purpose of the invention will be achieved, without being accompanied any practical problems, when the ratio b/a of the coefficient of linear expansion b of the protective layer 18 to the coefficient of linear expansion a of the heat resistant substrate 2 is in a range of 0.4 to 2.0, or preferably 0.6 to 1.4.

Since the coefficients of linear expansion of the heat resistant substrate 2 and protective layer 18 are nearly equal to each other, and the elasticity of the protective layer 18 is relatively small, when returning to an ordinary temperature of, for example, about 25° C. after heating and hardening when forming the protective layer 18, it is possible to prevent formation of warp of the heat resistant substrate 2 occurring when the coefficients of linear expansion differ as mentioned in the prior art. Consequently, it is possible to position at high precision when connecting the heat resistant substrate 2 and external wiring substrate 12, and the working efficiency in connection process is improved, and it is also possible to automate the work. Furthermore, when adhering the heat resistant substrate 2 and the cooling plate 15, mutual positioning may be done very precisely and easily, and still more it is effective to prevent uneven contrast in thermal recording action due to warp of the heat resistant substrate 2 as explained in relation to the prior art, thereby enhancing the printing quality.

Thus, in this embodiment, by nearly equalizing the coefficients of linear expansion of the heat resistant substrate 2 and the protective layer 18, it is possible to eliminate the stress taking place between the heat resistant substrate 2 and the protective layer 18 due to the effects of heat generation from the drive circuit elements 9 in manufacture or use, and heat in the environments of use, thereby preventing undesired peeling in the peripheral edge parts of the protective layer 18 due to such stress. Besides, the elasticity is about half that of the epoxy resin used in the prior art, and cracks of the protective layer 18 may be prevented due to heat cycle of heat test in manufacture or rise of temperature during use. This prevention of cracks is also achieved by the absence of warp in the heat resistant substrate 2 as mentioned in relation to the prior art.

By controlling the coating amount of the mixed resin material, changes in the degree of warp of the heat resistant substrate 2 may be avoided, and therefore if the size of the drive circuit elements 9 is changed, the protective layer 18 may be formed by using the same mixed resin material, thereby avoiding effects on the characteristics of the thermal head 1.

The protective layer 18 is relatively high in hardness and low in coefficient of friction as mentioned above. Hence, if the thermal paper 19 or transfer film contacts with the protective layer 18 during use, the protective layer 18 is not deformed or damaged, so that the head cover 25 may be downsized as explained in relation to the prior art, while a part of the protective layer 18 may be used as a part of the guide means when inserting the thermal paper 19, so that the number of parts may be curtailed and that the manufacturing process may be simplified.

As the drive circuit elements 9, if those with the layer thickness t1=0.55 mm are used, as compared with the prior art in which the height d1 of the protective layer 18 was, for example, 1.2 mm or less, the height d1 was confirmed to be set at 0.8 mm or less in this embodiment. This is because, when the conventional epoxy resin is used, a larger content of the filler is required since the coefficient of thermal expansion is lowered, so that the viscosity is raised. As a result, the interval of the platen roller 21 and protective layer 18 is extended, and the distance L1 of the drive circuit elements 9 and the heating resistance element row 8 may be shortened, which contributes to downsizing of the thermal head 1.

In the foregoing embodiment, the heat resistant substrate 2 is made of alumina ceramics, while the protective layer 18 is a resin mainly composed of polyether amide, but the invention is not limited to this embodiment alone, and the object of the invention will be achieved in other embodiments.

That is, if the substrate and resin are changed, as far as the coefficients of linear expansion of the two may be set nearly equivalently, the invention may be realized also in the following combinations of examples 1 to 9.

Figures in parentheses denote the coefficient of linear expansion (°C.$_{-1}$).

Example 1. Substrate: AIN--Resin: Polyether amide as base. (e.g. $0.5\times10^{-5}$)

Example 2. Substrate: SiC--Resin: Polyether amide as base. (e.g. $0.4\times10^{-5}$)

Example 3. Substrate: Zirconia--Resin: (e.g. $1.1\times10^{-5}$), Polyether amide as base.

Example 4. Substrate: Polyphenylene sulfide resin--Resin: (e.g. $2.5\times10^{-5}$) Epoxy compound.

Example 5. Substratrate: Al metal--Resin: Epoxy compound. (e.g. $2.4\times10^{-5}$).

Example 6. Substrate: Cu metal--Resin: Epoxy compound. (e.g. $1.7\times10^{-5}$).

Example 7. Substrate: Fe metal--Resin: (e.g. $1.2\times10^{-5}$) Polyether amide as base.

Example 8. Substrate: Fe-Ni alloy--Resin: (e.g. $0.7\times10^{-5}$) Polyether amide as base.

Example 9. Substrate: Ni metal--Resin: (e.g. $1.3\times10^{-5}$) Polyether amide as base.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A thermal head composed by disposing a plurality of drive circuit elements for driving heating resistance elements on a substrate having a coefficient of linear expansion on which a plurality of heating resistance elements are arranged linearly, and covering the drive circuit elements with a resin having a coefficient of linear expansion, wherein the resin and the substrate possess a substantially similar coefficient of linear expansion.

2. A thermal head of claim 1, wherein the ratio of the coefficient of linear expansion of the resin to the coefficient of linear expansion of the substrate is in a range of 0.4 to 2.0.

3. A thermal head of claim 2, wherein the ratio b/a is in a range of 0.6 to 1.4.

4. A thermal head of claim 1, wherein the resin is a synthetic resin material mainly composed of polyether amide molecules.

5. A thermal head of claim 2, wherein the resin is prepared by dispersing filler having nearly spherical forms.

6. A thermal head of claim 1, wherein the resin is mainly composed of polyether amide resin, blended with an epoxy resin, and blended with filler having nearly spherical forms.

7. A thermal head of claim 3 or 4, wherein is blended with a filler having nearly spherical forms, wherein the resin is present in a range of 70 to 95 wt. % of the filler.

8. A thermal head of claim 1, wherein the coefficient of linear expansion of the resin is $0.5\times10^{-5}$°C.$^{-1}$ to $1.0\times10^{-5}$°C.$^{-1}$, and the Young's modulus is selected in a range of 100 to 1000 kg/mm$^2$.

9. A thermal head of claim 5 wherein the filler has a particle size of up to 40 μm.

10. A thermal head of claim 6 wherein the filler has a particle size of up to 40 μm.

11. A thermal head of claim 7 wherein the filler has a particle size of up to 40 μm.

12. An improved thermal head wherein a plurality of drive circuit elements for driving heating resistance elements are disposed on a substrate having a coefficient of linear expansion on which a plurality of heating resistance elements are arranged linearly, and the drive circuit elements are covered with a resin having a coefficient of linear expansion, wherein the improvement comprises:

the resin and substrate posses a substantially similar coefficient of linear expansion.

13. The thermal head of claim 12 wherein the ratio of the coefficient of linear expansion of the resin to the coefficient of linear expansion of the substrate is in a range of 0.4 to 2.0.

14. The thermal head of claim 13 wherein the ratio ranges from 0.6 to 1.4.

15. The thermal head of claim 13 wherein the resin is mixed with a filler having nearly spherical forms and a particle size of up to 40 μm.

16. The thermal head of claim 15 wherein the resin is mainly composed of polyether amide.

17. The thermal head of claim 16 wherein the polyether amide/filler mixture is blended with an epoxy resin.

18. The thermal head of claim 16 wherein the resin is present in a range of 70 to 95 wt. % of the filler.

19. The thermal head of claim 12 wherein the coefficient of linear expansion of the resin is $0.5\times10^{-5}$°C.$^{-1}$ to $1.0\times10^{-5}$°C.$^{-1}$, and the resin has a Young's modulus ranging from 100 to 1000 kg/mm$^2$.

* * * * *